US006748731B2

(12) United States Patent
Kobayashi et al.

(10) Patent No.: US 6,748,731 B2
(45) Date of Patent: Jun. 15, 2004

(54) TIRE CORD

(75) Inventors: Takanori Kobayashi, Ono (JP); William E. Smith, Conway, AR (US); Charles E. Smith, Jr., Conway, AR (US)

(73) Assignee: Tokusen U.S.A., Inc., Conway, AR (US)

( * ) Notice: Subject to any disclaimer, the term of this patent is extended or adjusted under 35 U.S.C. 154(b) by 108 days.

(21) Appl. No.: 10/118,264

(22) Filed: Apr. 8, 2002

(65) Prior Publication Data

US 2003/0188525 A1 Oct. 9, 2003

(51) Int. Cl.[7] ..... D07B 1/06
(52) U.S. Cl. ..... 57/212; 57/236; 57/248
(58) Field of Search ..... 57/210, 212, 236, 57/243, 248, 902

(56) References Cited

U.S. PATENT DOCUMENTS

| | | | | |
|---|---|---|---|---|
| 3,712,362 | A | | 1/1973 | Alderfer |
| 3,802,982 | A | | 4/1974 | Alderfer |
| 3,815,652 | A | | 6/1974 | Pouilloux |
| 3,934,633 | A | | 1/1976 | Bula |
| 4,022,009 | A | | 5/1977 | van Assendelft |
| 4,098,315 | A | | 7/1978 | Ferrell et al. |
| 4,126,720 | A | | 11/1978 | Edwards |
| 4,231,408 | A | | 11/1980 | Replin |
| 4,399,853 | A | | 8/1983 | Morimoto et al. |
| 4,545,190 | A | * | 10/1985 | Rye et al. ..... 57/212 |
| 4,718,470 | A | | 1/1988 | Kusakabe et al. |
| 4,869,307 | A | | 9/1989 | Bormann et al. |
| 4,917,744 | A | | 4/1990 | Knipp et al. |
| 4,964,451 | A | | 10/1990 | Schmidt |
| 4,989,658 | A | | 2/1991 | Maathuis et al. |
| 5,198,307 | A | * | 3/1993 | Bourgois et al. ..... 428/589 |
| 5,285,623 | A | | 2/1994 | Baillievier et al. |
| 5,319,915 | A | | 6/1994 | Kobayashi et al. |
| 5,718,783 | A | | 2/1998 | Ikehara |
| 5,879,484 | A | | 3/1999 | Spragg et al. |
| 6,089,293 | A | | 7/2000 | Niderost |
| 6,148,885 | A | | 11/2000 | Spragg et al. |
| 6,244,318 | B1 | | 6/2001 | Shoyama |
| 6,260,598 | B1 | | 7/2001 | Tanaka |
| 6,318,432 | B1 | | 11/2001 | Caretta et al. |

FOREIGN PATENT DOCUMENTS

| | | |
|---|---|---|
| EP | 0403420 A2 | 12/1990 |
| EP | 0715971 A2 | 6/1996 |
| JP | 9-175112 | 7/1997 |
| JP | 2000-96464 | 4/2000 |

OTHER PUBLICATIONS

International Search Report, ISA/US, for International Patent Application No. PCT/US03/10824, Mailing Date Oct. 23, 2003, 3 pages.

* cited by examiner

*Primary Examiner*—John J. Calvert
*Assistant Examiner*—Shaun R Hurley
(74) *Attorney, Agent, or Firm*—Ray F. Cox, Jr.

(57) ABSTRACT

A tire cord having core filaments preformed into a helical configuration while maintaining the core filaments in a parallel, side-by-side relationship. The core filaments are not twisted or stranded together. High tensile strength sheath filaments are also preformed into a flattened helical configuration so that the sheath filaments can be wrapped around the side-by-side core filaments such that the sheath filaments do not put such tension on the core filaments as to cause the core filaments to bunch. The core filaments are maintained in a flat, side-by-side configation so that no voids are formed and rubber can penetrate into the tire cord. The core filaments may number from three to six and the sheath filaments from one to seven. The cross-section of the tire cord is flattened and confined within an oval-shaped outer bound, the oval outer bound being characterized by a major axis and a minor axis. It is desirable that the minor axis be no greater than 60% of the major axis to created the appropriate difference in the bending modulus of the tire cord in the horizontal versus the vertical direction.

10 Claims, 1 Drawing Sheet

TIRE CORD

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates to a metallic cord for the reinforcement of elastomeric articles, and in particular, to a tire cord useful in the reinforcement of pneumatic tires and that provides the tire with features of both good cornering ability and ride comfort.

2. Brief Description of the Related Art

Steel tire cords, such as the kind used in steel-belted tires, may be manufactured from a plurality of core filaments which are wrapped in a plurality of sheath filaments. More core filaments are required to achieve higher strengths, but when three or more core filaments are required, the core filaments tend to bunch together and form a void in the center of the bunched filaments. When the cord is bonded in a layer of rubber, the rubber cannot easily penetrate into and fill the voids. If the tire is then perforated, water may enter the voids and corrode the tire cord.

Recent tire designs require thinner rubber gauges and/or wider cord spacing in the belts in order to produce lighter weight tires. These designs are known to be better for automobile fuel efficiency and ride quality.

In addition, passenger car tires require cords that provide lateral maneuverability, i.e., good cornering, and low bending stiffness for ride comfort and maximum contact with the road surface. To achieve the desired lateral stiffness, larger diameter filaments are typically used for construction of the tire cord. As these diameters increase to improve cornering, the tire belts become stiffer in the vertical plane causing uncomfortable ride and smaller tire contact area with the road.

Typical tire construction uses tire cords having 0.15–0.40 mm brass plated steel filaments. If high breaking loads are required of a cord, an increase in the number of filaments is necessary. When cords are stranded with three or more filaments, a void may be created in the center of the cord. The cord then does not have enough space between filaments to allow rubber to penetrate into the void during tire curing and the cord may suffer from reduced adhesion. A reduction in adhesion may result in the tire having a belt separation. Furthermore, if a cord has a void center, it may be corroded easily by water if the belt area is penetrated by any road hazard. This is especially a concern since the full length of cord in the belt may be corroded by water wicking through the void space. The resulting corrosion degrades the mechanical properties and the fatigue resistance of the cord such that tire failure may occur.

Various tire cord constructions have been developed to improve the rubber penetration into the cord and to avoid the problem of voids within the tire cord.

(1) Open constructions are those created by pre-forming a large amplitude wave into the filaments with a frequency equal to the cord pitch to create a small elongation spring-type cord.

(2) Wavy filament constructions have one or more small wave filaments, whose pitch is smaller than the cord's pitch. The small openings created by this construction allow rubber to penetrate the core.

(3) The tire cord constructions known as 1×2 and 2+2 are completely rubber penetrated.

Information relevant to other attempts to address the problems described above can be found in various U.S. Patents as described following.

U.S. Pat. No. 5,718,783 to Ikehara discloses a steel cord comprising a single helical core filament and five to eight sheath filaments. The pitch and the amplitude of the helical core filament are set within certain ranges depending upon the diameter of the core filament and the number of sheath filaments.

U.S. Pat. No. 6,244,318 to Shoyama discloses a tire cord formed from a single core filament and a plurality of sheath layers formed by helical windings about the core.

U.S. Pat. No. 6,089,293 to Niderost discloses a rubber ply in which the reinforcing cords have different properties at different points in the ply. The differing properties are achieved by having the cords twisted together helically and having different helical diameters in different parts of the ply.

U.S. Pat. No. 3,802,982 to Aldefer discloses a tire where the reinforcing is provided by a plurality of helically formed single filament cords.

U.S. Pat. No. 5,285,623 to Baillievier et al. disclose a steel cord comprising two strands of at least two filaments each. The strands are twisted about each other forming helicoids of the same pitch. The filaments of one of the strands has a pitch of more than 300 mm, i.e., the filaments of this stand are not twisted to any significant degree.

However, all of these tire cords have some limitations. The filaments of open constructions can move easily because they are loosely stranded. Therefore, it is difficult to keep a stable cord shape and the cord basically is not uniform. Tension control in the calendaring process is also very important for open cords and must be kept low in order to allow good rubber penetration. If open constructions are used in high-tension calendars, the openness along with rubber penetration may be lost when the cord closes during elongation. Problems with calendar sheet rubber gauge are also evident with open cords. The larger openness that is required to assure rubber penetration also increases the cord's diameter and requires an increased rubber gauge to accommodate the size of the cord.

Wavy constructions are less effective in keeping good rubber penetration in higher strength applications where an increase in the number of filaments is required in a cord. This is because the wavy construction creates relatively small openings in the cord and, as a result, do not allow for large amounts of rubber flow during curing.

The cord types known as 1×2 and 2+2 also present problems for tire design because they require a fixed number of filaments. Larger filament diameters, higher tensile steels, or even increased EPI (ends per inch) in the calendar must be utilized to get higher strength for tire belts. Larger filament diameters and higher EPI both are contrary to lightweight tire design.

More recently, another construction has been introduced to meet the requirements of rubber penetration into the cords and lateral belt stability in tires. This construction, as disclosed in Japanese Published Patent Application 2000-096464, uses all parallel filaments that are wrapped with a single, thin, low strength wrapping filament. However, actual production of this construction is difficult because the low-strength wrapping filament cannot keep the parallel core filaments from flaring unless a very short wrapping pitch is used. This reduces production output because wrapping machine speeds are constrained by a maximum machine RPM. Furthermore, this construction has difficulty keeping a large number of filaments flat because the wrapping filament does not have enough strength to hold the filaments flat. Higher breakload cords are unavailable since the number of filaments is limited. In addition, the thin wrapping filament does not contribute significantly to the breaking strength of the cord.

The limitations of the prior art are overcome by the present invention as described below.

BRIEF SUMMARY OF THE INVENTION

The present invention solves the problems discussed above by forming at least two, and preferably three, core filaments of the tire cord into a helical configuration while maintaining the core filaments in a parallel, side-by-side relationship. The core filaments are not twisted or stranded together. In other words, the pitch (the length of one complete twist of the core filaments) is effectively infinite. In practice, this means a pitch of at least 300 mm. The sheath filaments are also formed into a flattened helical configuration so that the sheath filaments are wrapped around the side-by-side core filaments. In this way, the sheath filaments do not put such tension on the core filaments as to cause the core filaments to bunch. Rather, the core filaments are maintained in the flat, side-by-side configuration so that no voids are formed and rubber can penetrate into the tire cord. Both the sheath filaments and the core filaments contribute substantially to the breaking strength of the tire cord. This differs from the prior art in which a wrapping filament of low tensile strength is used with a plurality of parallel core filaments.

The core filaments of the present invention are therefore characterized in being both parallel and maintained in a side-by-side relationship. Core filaments numbering three or more may be formed in a parallel configuration, i.e., not twisted together, while sheath filaments are bunched around the core. It is a significant aspect of the present invention that the core filaments remain in a side-by-side configuration. A side-by-side configuration may be explained by considering a cord stretched out in a longitudinal direction in a horizontal plane. As explained below, the flattened helical configuration of the cord implies that any cross section of the cord is confined within a generally oval-shaped outer bound characterized by a major axis, which will be considered horizontal, and a minor axis, which will be considered vertical. The core filaments are in a side-by-side configuration if, at each longitudinal point along the cord, a line perpendicular to the length of the cord and lying in a horizontal plane could be made to pass through the centerline of each of the core filaments.

The invention can be practised with various numbers of core filaments and sheath filaments. Desirably, the core filaments will number from two to six and the sheath filaments from one to seven.

As mentioned above, it will be understood that the flat configuration of the core filaments and the flattened helical configuration of the sheath filaments determines that any cross-section of the tire cord is also flattened and confined within an oval-shaped outer bound, the oval outer bound being characterized by a major diameter along a major axis and a minor diameter along a minor axis. It is desirable that the minor diameter be no greater than 60% of the major diameter to create the appropriate difference in the bending modulus of the tire cord in the vertical versus the horizontal direction. Greater stiffness in the horizontal direction is desirable for good cornering, while reduced stiffness in the vertical direction is desirable for good ride comfort.

In order to produce tire cord having the desirable configuration of the present invention, it is desirable that the cord and filament dimensions satisfy the following mathematical relationship:

$$1.5\times d_c \leqq (D_h - 2\times d_s) \leqq m\times d_c + d_s, \text{ where}$$

$d_c$=the diameter of a core filament,
$D_h$=the peak to peak height of the sheath wave across the horizontal direction (major axis), i.e., the major diameter,
$d_s$=the diameter of the sheath filament, and
m=the number of core filaments.

While the diameter of the core filaments may differ from the diameter of the sheath filaments, it may be desirable in some applications that the diameters be the same or substantially the same.

The tire cord of the present invention, when used in rubber tire belts, demonstrates good cornering ability, low stiffness for a smooth ride, good rubber penetration for cord integrity, and amenability to high production rates. The tire cord also allows for thinner rubber gauges and/or wider cord spacing in the belts in order to produce lighter weight tires, which contribute to automobile fuel efficiency and ride quality.

These and other features, objects and advantages of the present invention will become better understood from a consideration of the following detailed description of the preferred embodiments and appended claims in conjunction with the drawings as described following.

DETAILED DESCRIPTION OF THE INVENTION

Figure 1:
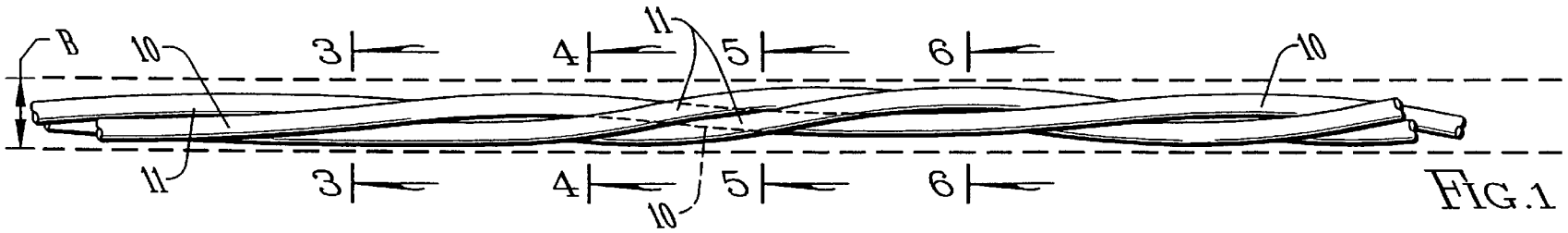
FIG. 1 is a side elevation view of the tire cord of the present invention.
Figure 2:
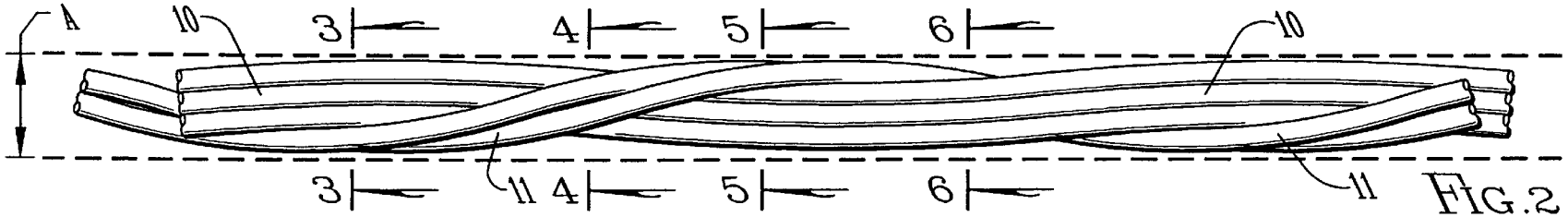
FIG. 2 is a top plan view of the tire cord of the present invention.
Figure 3:
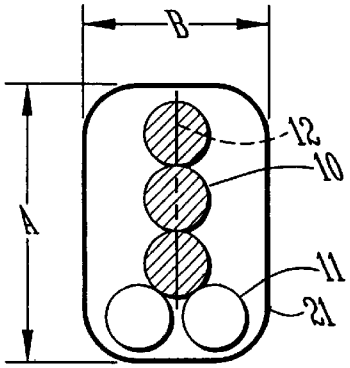
FIG. 3 is a cross sectional view of the tire cord of FIGS. 1 and 2 along the line 3—3 of FIGS. 1 and 2.
Figure 4:
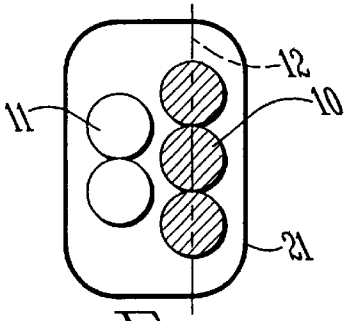
FIG. 4 is a cross sectional view of the tire cord of FIGS. 1 and 2 along the line 4—4 of FIGS. 1 and 2.
Figure 5:
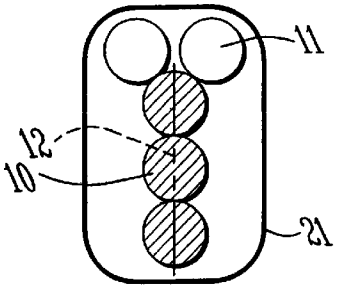
FIG. 5 is a cross sectional view of the tire cord of FIGS. 1 and 2 along the line 5—5 of FIGS. 1 and 2.
Figure 6:
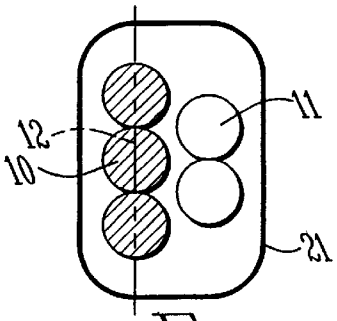
FIG. 6 is a cross sectional view of the tire cord of FIGS. 1 and 2 along the line 6—6 of FIGS. 1 and 2.

The tire cord of the present invention is described with respect to FIGS. 1–6. The tire cord 20 has at least three core filaments 10. The core filaments are indicated in FIGS. 3–6 by cross hatching. It is desirable that the core filaments 10 number no more than six. The sheath filaments 11 (shown without cross hatching in FIGS. 3–6) desirably number one to seven. The filament diameter C of the sheath filament 11 may differ from the diameter of the core diameter D of the core filament 11, although in some applications it may be desirable that the sheath filament diameter C is the same or substantially the same as the core filament diameter D. The core filaments 10 are not stranded or twisted together. In other words, the pitch (the length of one complete twist of the core filaments) is effectively infinite. In practice, this means a pitch of at least 300 mm.

It is a significant aspect of the present invention that both the sheath filaments 11 and the core filaments 10 contribute substantially to the breaking strength of the tire cord 20. As used herein, the term "contribute substantially" is intended to differentiate the filaments of the present invention from the prior art in which a wrapping filament of low tensile strength is used to maintain parallel a plurality of higher tensile strength core filaments but the wrapping filament does not contribute substantially to the breaking strength of the tire cord, which is determined primarily by the core filaments. In the present invention, therefore, the sheath filament 11 contributes substantially to the breaking strength of the tire cord 20 along with the core filament 10, whereas in the prior art the wrapping filament does not contribute substantially to the breaking strength of the tire cord 20. The strength of the sheath filament 11 also contributes to the maintenance of the flat, parallel, side-by-side configuration of the core filaments 10.

The tire cord 20 does not contain a void center because the core filaments 10 are formed into helix where the core filaments 10 are parallel to each other and remain in a "flat" side-by-side configuration. A "flat" side-by-side configuration refers to an alignment of the core filaments 10 such that at each point along the longitudinal length of the tire cord 20 a substantially straight transverse line 12 may be drawn through the centerline of each of the core filaments 10 as shown in FIGS. 3–6.

If the core filaments 10 number less than two, the tire cord 20 cannot achieve the bending modulus improvement in tire reinforcement and if the core filaments 10 number more than six, the parallel helix is difficult to maintain. It is not necessary for the core filaments 10 to be perfectly parallel while following the helix. If the core filaments basically align as a parallel helix, some points where a core filament 10 is "changing position" have little effect and will not diminish the properties of the tire cord 20.

The sheath filaments 11 are also formed into a flattened helical configuration. The sheath filaments 11 are wrapped around the side-by-side core filaments 10 such that the peak of the sheath filament wave occurs at the trough of the core filament wave and vice versa. In this way, the sheath filaments 11 do not put such tension on the core filaments 10 as to cause the core filaments 10 to bunch and form a void center.

The flat, side-by-side arrangement of the core filaments 10 and the flattened helical configuration of the sheath filaments 11 wrapped around the core filaments 10 determines that any cross-section of the tire cord 20 is also flattened and confined within an oval-shaped outer bound 21, the oval outer bound 21 being characterized by a major diameter A along a major axis and a minor diameter B along a minor axis. It is desirable that the minor diameter B be no greater than 60% of the major diameter A to create the appropriate difference in the bending modulus of the tire cord 20 in the vertical (around the major axis) versus the horizontal (around the minor axis) directions.

If the tire cord 20 achieves this difference in bending modulus between the vertical and horizontal cross sections, the tire cord 20 can be oriented in a rubber calendar sheet with the major diameter A aligned with the width of the calendar sheet. Greater stiffness in the horizontal direction is desirable for good cornering, while reduced stiffness in the vertical direction is desirable for good ride comfort. Since the minor diameter B of the tire cord 20 is smaller than normal tire cord constructions, thinner rubber calendar sheets are achievable. Furthermore, the major diameter A of the tire cord 20 is larger than normal tire cord constructions. Therefore, the EPI of the calendar sheets may be reduced while maintaining the same space between cords as in previous constructions.

The sheath filament diameter C must be large enough to create sufficient wrapping strength to keep the core filaments 10 substantially aligned in a parallel, flat, side-by-side helix. However, if the sheath filaments 11 number more than seven, rubber penetration of the cord suffers since the space between wraps becomes too small. The tire cord 20 is very difficult to produce by ordinary bunching machine techniques since the parallel core filaments 10 tend to form a round core, and thus an undesirable void center, in the bunching process. The tire cord 20 of the present invention requires a sheath filament 11 with a longer length than previous tire cord constructions in order to wrap around the core filaments 10 arranged in a "flat" side-by-side configuration without putting such tension on the core filaments 10 as to cause them to bunch together. The extra length can be obtained by using casting pins to wave the sheath filaments 11 or by using a false twister prior to the bunching process. However, since the core filaments 10 are also cast with a helical waveform, the diameters of the cord become effectively smaller with respect to the required length of the sheath filament 11. The relationship can then be described by the following equation:

$$1.5\times d_c \leqq (D_h - 2\times d_s) \leqq m\times d_c + d_s, \text{ where}$$

$d_c$=the core filament diameter (D),
$D_h$=the major diameter (A),
$d_s$=the sheath filament diameter(C), and
m=the number of core filaments.

If $(D_h-2\times d_s)$ is more than $(m\times d_c+d_s)$, it is very difficult to produce in a buncher machine. If $(D_h-2\times d_s)$ is less than $(1.5\times d_c)$, the tire cord has poor uniformity and the features of the cord are not guaranteed.

The tire cord 20 produced by the present invention provides good rubber penetration, large power of resistance to cornering force with respect to the bending stiffness in the horizontal plane, and a comfortable ride with wide contact area based on the low stiffness in the vertical plane of a tire.

EXAMPLE

The tire cords described in this example were stranded by a buncher-type stranding machine. Table 1 compares the evaluated mechanical property data of the tire cord 20 of the present invention to prior art constructions.

TABLE 1

| Example | Prior Art | Prior Art | Invention |
|---|---|---|---|
| Construction | 1 × 5 × 0.35 | 3 + 2 × 0.35 | 3 + 2 × 0.35 |
| Type | Open | Round | Flat |
| $D_h$-2x$d_s$ (mm) | | | 0.73 |
| Lay Length (mm) | 18 | 18 | 18 |
| Cord Diameter (mm) | | | |
| Maximum | 1.24 | 1.11 | 1.45 |
| Minimum | 1.20 | 1.01 | 0.76 |
| Ovality (%) | 96.8 | 91 | 53.1 |
| Breaking Load (kg) | 150 | 155 | 155 |

TABLE 1-continued

| Example | Prior Art | Prior Art | Invention |
|---|---|---|---|
| Rubber Penetration (%) | 100 | 60 | 100 |
| Bending Stiffness | 115.8 | 112.3 | 101.3/192.1 |

Tables 2A and 2B compare the evaluated mechanical property data of normal M+N type constructions (Table 2A) versus tire cord 20 of the present invention (Table 2B).

TABLE 2A

| Prior Art | | | |
|---|---|---|---|
| Construction<br>Filament Diameter (mm) | 3 + 5 | 3 + 1 | 6 + 2 |
| Core | 0.35 | 0.35 | 0.35 |
| Sheath | 0.35 | 0.15 | 0.35 |
| $D_h$-2x$d_s$ (mm) | 0.85 | 1.35 | 1.23 |
| Ovality (%) | 69 | 92 | 79 |
| Lay Length (mm) | 18 | 14 | 18 |
| Uniformity in Sheet (%) | 74 | | 60 |
| Rubber Penetration (%) | 50 | 80 | 60 |
| Core Filament Uniformity | G | G | NG |
| Parallelness | G | NG | NG |

TABLE 2B

| Invention | | |
|---|---|---|
| Construction<br>Filament Diameter (mm) | 3 + 2 | 4 + 3 |
| Core | 0.35 | 0.35 |
| Sheath | 0.35 | 0.35 |
| $D_h$-2x$d_s$ (mm) | 0.72 | 1.00 |
| Ovality (%) | 53 | 45 |
| Lay Length (mm) | 18 | 18 |
| Uniformity in Sheet (%) | 100 | 100 |
| Rubber Penetration (%) | 100 | 100 |
| Core Filament Uniformity | G | G |
| Parallelness | G | G |

The maximum and minimum tire cord diameters were measured by turning each tire cord in a thickness dial gage. The ovality was calculated as follows: minimum cord diameter/maximum cord diameter×100%. The breaking load was measured using a tensile tester to elongate the uncoated cords until failure. The rubber penetration was evaluated by observing bare wire areas remaining, after first embedding the tire cord in rubber and then removing the sheath filaments from the core filaments. The results were recorded as a percentage of complete coverage.

The bending stiffness was measured by the following method:

1. Embed a length of cord (>10 cm) and cure in rubber.
2. Cut the rubber away from the cord with a knife. Trim cord to 10 cm.
3. Put the sample on pivot bars arranged parallel at a 5 cm distance.
4. Apply force down in the middle of the sample until deflection equals 3 mm.
5. Measure the force required to bend the sample to 3 mm.

Table 1 compares prior art tire cords to the tire cord 20 of the present invention. Bending stiffness of the tire cord 20 of the present invention is displayed as two numbers. The higher value relates to the bending stiffness when deflecting the cord about the minor axis. The smaller value corresponds to the bending stiffness about the major axis. From the data shown, the tire cord of the present invention exhibits qualities that can provide both a comfortable ride with a large contact area with the road, and better cornering ability with respect to bending stiffness.

To evaluate the uniformity of orientation in the calendar sheet, an x-ray photo of the calendar sheet was taken and then the embedded cords were counted when the maximum cord diameter was visible. The data shown was calculated as follows: (Counted cord number/Total cord number)×100%. A score of 100% means that all of the cords were oriented with the maximum cord diameter side visible in the x-ray.

The parallelness evaluates how effectively the core filaments 10 follow the same helical path. "G" (Good) indicates that the core filaments 10 substantially follow the same path. If core filaments 10 did not meet this criteria, the sample was evaluated "NG" (No Good).

The tire cord 20 of the present invention exhibits characteristics of excellent rubber penetration, significant bending stiffness differential, and ability for orientation when embedded in a calendar sheet.

The present invention has been described with reference to certain preferred and alternative embodiments that are intended to be exemplary only and not limiting to the full scope of the present invention as set forth in the appended claims.

What is claimed is:

1. A tire cord adapted for the reinforcement of an elastomeric article, comprising:

a first group of filaments having a core filament number of from three to six core filaments and forming a helix along a longitudinal direction wherein said core filaments are not twisted together and said core filaments are arranged in a substantially parallel, substantially side-by-side configuration; and a second group of filaments having a sheath filament number of from one to seven sheath filaments and forming a flattened helix in the same sense as said helix of said core filaments, said second group being twisted about said first group in the same sense as said helix of said core filaments;

wherein each of said core filaments and said sheath filaments contribute substantially to a breaking strength of said tire cord;

wherein each of said core filaments is characterized by a core filament diameter and each of said sheath filaments is characterized by a sheath filament diameter; and wherein any cross section of said tire cord along said longitudinal direction is contained within a generally oval-shaped outer bound characterized by a major diameter along a major axis and a minor diameter along a minor axis.

2. The tire cord of claim 1 wherein said minor diameter is no greater than 60% of said major diameter.

3. The tire cord of claim 2 wherein said tire cord satisfies the equation:

$$1.5\times d_c \leqq (D_h-2\times d_s) \leqq m\times d_c+d_s,$$

where $d_c$=said core filament diameter, $D_h$=said major diameter, $d_s$=said sheath filament diameter, and m=said core filament number.

4. The tire cord of claim 1 wherein said tire cord satisfies the equation:

$$1.5\times d_c \leqq (D_h-2\times d_s) \leqq m\times d_c+d_s,$$

where $d_c$=said core filament diameter, $D_h$=said major diameter, $d_s$=said sheath filament diameter, and m=said core filament number.

5. The tire cord of claim 1, wherein said sheath filament diameter is substantially the same as said core filament diameter.

6. A tire cord adapted for the reinforcement of an elastomeric article, comprising:

a first group of filaments having a core filament number of from two to six core filaments and forming a helix along a longitudinal direction wherein said core filaments are not twisted together and said core filaments are arranged in a substantially parallel, substantially side-by-side configuration; and a second group of filaments having a sheath filament number of from one to seven sheath filaments and forming a flattened helix in the same sense as said helix of said core filaments, said second group being twisted about said first group in the same sense as said helix of said core filaments;

wherein each of said core filaments and said sheath filaments contribute substantially to a breaking strength of said tire cord;

wherein each of said core filaments is characterized by a core filament diameter and each of said sheath filaments is characterized by a sheath filament diameter; and wherein any cross section of said tire cord along said longitudinal direction is contained within a generally oval-shaped outer bound characterized by a major diameter along a major axis and a minor diameter along a minor axis, such that said minor diameter is no greater than 60% of said major diameter.

7. The tire cord of claim 6 wherein said tire cord satisfies the equation:

$$1.5\times d_c \leqq (D_h-2\times d_s) \leqq m\times d_c+d_s,$$

where $d_c$=said core filament diameter, $D_h$=said major diameter, $d_s$=said sheath filament diameter, and m=said core filament number.

8. The tire cord of claim 6, wherein said sheath filament diameter is substantially the same as said core filament diameter.

9. A tire cord adapted for the reinforcement of an elastomeric article, comprising:

a first group of filaments having a core filament number of from two to six core filaments and forming a helix along a longitudinal direction wherein said core filaments are not twisted together and said core filaments are arranged in a substantially parallel, substantially side-by-side configuration; and a second group of filaments having a sheath filament number of from one to seven sheath filaments and forming a flattened helix in the same sense as said helix of said core filaments, said second group being twisted about said first group in the same sense as said helix of said core filaments;

wherein each of said core filaments and said sheath filaments contribute substantially to a breaking strength of said tire cord;

wherein each of said core filaments is characterized by a core filament diameter and each of said sheath filaments is characterized by a sheath filament diameter satisfying the equation:

$$1.5\times d_c \leqq (D_h-2\times d_s) \leqq m\times d_c+d_s,$$

where $d_c$=said core filament diameter, $D_h$=said major diameter, $d_s$=said sheath filament diameter, and m=said core filament number; and wherein any cross section of said tire cord along said longitudinal direction is contained within a generally oval-shaped outer bound characterized by a major diameter along a major axis and a minor diameter along a minor axis, such that said minor diameter is no greater than 60% of said major diameter.

10. The tire cord of claim 9, wherein said sheath filament diameter is substantially the same as said core filament diameter.

* * * * *